United States Patent [19]

Mendenhall

[11] Patent Number: 5,061,500

[45] Date of Patent: Oct. 29, 1991

[54] EASY OPENING MICROWAVABLE PACKAGE

[75] Inventor: Abraham H. Mendenhall, Mendham, N.J.

[73] Assignee: Packaging Concepts, Inc., St. Louis, Mo.

[21] Appl. No.: 350,217

[22] Filed: May 11, 1989

Related U.S. Application Data

[63] Continuation of Ser. No. 44,642, May 1, 1987, abandoned, which is a continuation-in-part of Ser. No. 913,964, Oct. 1, 1986, abandoned.

[51] Int. Cl.[5] ..... B65D 81/34

[52] U.S. Cl. ..... 426/118; 426/107; 426/113; 426/127; 426/234; 426/415; 206/632; 383/100; 493/214; 493/220; 53/412; 53/479; 53/481; 156/308.4

[58] Field of Search ..... 426/107, 113, 118, 234, 426/243, 412, 127, 415; 493/220, 214, 264, 266, 962, 193, 194, 208; 53/481, 412, 479; 156/308.4, 217; 206/632; 383/100

[56] References Cited

U.S. PATENT DOCUMENTS

| | | | |
|---|---|---|---|
| 2,237,327 | 4/1941 | Bell | 493/264 |
| 2,595,708 | 5/1952 | Salfisberg | 426/118 |
| 2,633,284 | 3/1953 | Moffett et al. | 426/113 |
| 3,052,554 | 9/1962 | Colman | 426/111 |
| 3,108,881 | 10/1963 | Shaw et al. | 426/412 |
| 3,204,760 | 9/1965 | Whiteford | 426/113 |
| 3,261,140 | 7/1966 | Long et al. | 426/234 |
| 3,293,048 | 12/1966 | Kitterman | 426/113 |
| 3,314,591 | 4/1967 | Cheeley | 426/412 |
| 3,637,132 | 1/1972 | Gray | 426/118 |
| 3,716,180 | 2/1973 | Bemiss et al. | 426/118 |
| 3,716,369 | 2/1973 | Perlman | 426/412 |
| 3,865,302 | 2/1975 | Kane | 426/113 |
| 3,935,810 | 2/1976 | Milano | 426/113 |
| 3,997,677 | 12/1976 | Hirsch | 426/118 |
| 4,013,798 | 3/1977 | Goltsos | 426/118 |
| 4,141,487 | 2/1979 | Faust | 426/113 |
| 4,261,504 | 4/1981 | Cowan | 426/113 |
| 4,358,466 | 11/1982 | Stevenson | 426/113 |
| 4,404,241 | 9/1983 | Mueller et al. | 426/113 |
| 4,456,164 | 6/1984 | Foster | 426/113 |
| 4,461,031 | 7/1984 | Blamer | 426/113 |
| 4,571,337 | 2/1986 | Cage | 426/118 |
| 4,667,453 | 5/1987 | Goglio | 53/481 |
| 4,691,374 | 9/1987 | Watkins | 426/111 |
| 4,705,707 | 11/1987 | Winter | 426/107 |
| 4,716,061 | 11/1987 | Winter | 426/107 |

FOREIGN PATENT DOCUMENTS

| | | | |
|---|---|---|---|
| 697723 | 9/1953 | United Kingdom | 426/120 |

*Primary Examiner*—Steven Weinstein
*Attorney, Agent, or Firm*—Paul M. Denk

[57] ABSTRACT

An improved microwavable package of laminar construction, having its inner layer constructed of a film whose inherent seal strength is sufficiently high that the inside of the package need not have extraneous reinforcement to maintain its integrity filling, storage, distribution and cooking. The microwavable package is ventable and easily opened by virture of a strip of heat sealable adhesive coated along its top edge immediately inside the opening of the bag and having a seal strength less than that of the package formed seals, to mask the package's normal seal strength.

1 Claim, 1 Drawing Sheet

EASY OPENING MICROWAVABLE PACKAGE

CROSS REFERENCE TO RELATED APPLICATION

The subject matter of this application is a continuation of the application having Ser. No. 44,642, filed on May 1, 1987, now abandoned, which in turn is related to and comprises a continuation-in-part of the patent application to the same inventor filed on Oct. 1, 1986, Ser. No. 913,964, now abandoned, upon Microwavable Package Incorporating Controlled Venting, and owned by a common assignee.

BACKGROUND OF THE INVENTION

This invention relates to a package for use in the microwaving of cookable items, such as popcorn, other food products, or other substances, and more specifically pertains to the easy opening feature of such packages wherein the packages at the top opening are characterized by a peelable seal, which seal is strong enough to maintain the closure as against the heat required for cooking and pressure generated thereby, but which nevertheless is permeable to steam, thus allowing the bag to vent itself, and furthermore, is a sufficiently releasable seal to permit consumers to peel open the package conveniently without exerting undue force.

Another key aspect of prior art microwavable packages, aside from the ventable easy opening closure, is that the package maintains its integrity during filling, storage, distribution and cooking. The package must be sufficiently impervious to cooking oil that it will not weep or bleed oil during a reasonable grocery store shelf life at room temperature, nor during the ensuing cooking and serving usage of the package. The package must not rupture or prematurely open during cooking by virtue of heat and/or pressure in the package during its shelf life. Also, the side and bottom walls of the package, unlike the top closure, must provide a proper barrier against moisture or steam permeation.

Previously, in order to accommodate the broad and comprehensive attributes of a microwavable package, particularly for popcorn, it has been necessary to construct such packages or bags of laminar materials having at least an inner lining or layer and an outer layer for each of the side and bottom walls of said package or bag. The inner layer's fabrication has been restricted to a particular film such as a polyester which is one of the only films commercially available which can withstand the heat of the microwave cooking while also having the tendency to break or peel away at the top during cooking to provide venting and easy opening of the package by the consumer subsequent to cooking.

However, such film materials are characterized by having such low seal strength along the side wall and bottom edges and seals of the package that it has been necessary to reinforce such packages with paper-to-film adhesion in order to prevent bleeding, weeping and other deleterious breakdowns in the package integrity, and to give strength to the package in general. Consumers have even been known to use supplemental wrapping of such bags to prevent moisture permeation and manufacturers have also restricted the types of foods which they package in such easy opening or as sometimes referred to as self-opening style (SOS) microwavable bags.

Various U.S. patents disclosing miscellaneous types of microwavable packages for popcorn and the like which have easy opening features include the following: U.S. Pat. No. 4,571,337; U.S. Pat. No. 2,865,768; U.S. Pat. No. 3,973,045; U.S. Pat. No. 3,052,554; U.S. Pat. No. 4,358,466; U.S. Pat. No. 2,189,174; U.S. Pat. No. 3,851,574; U.S. Pat. No. 4,292,332; U.S. Pat. No. 2,633,284; U.S. Pat. No. 3,478,952; and U.S Pat. No. 3,511,746.

It would therefore represent a substantial advancement in the art if a microwavable bag were provided which would be ventable and easily opened at its top closure without the need for additional structural materials to reinforce the bag against absorption of moisture and/or oil during storage, cooking, subsequent heating and/or distribution or filling of the microwavable bag, and which bag could or would be resistant to other deleterious breakdowns to its structural integrity.

SUMMARY OF THE INVENTION

It is, therefore, a principal object of the present invention to provide a microwavable bag, which has the attributes of resistance against absorption of the food, its oil, or its moisture into the bag, either during storage, filling, cooking, shipment or distribution of the product, or during subsequent heating, while at the same time, providing a moisture barrier against either the entrance of moisture into the bag, which may under usual circumstances cause deleteriousness to the food stored therein, or allow moisture to escape from the bag, causing its deterioration.

It is a further object of this invention to provide a microwavable bag which retains its seals, throughout its periphery, even during and subsequent to microwaving, while at the same time, affording sufficient venting and an easy opening closure at the top of said bag without the need for extraneous reinforcements either inside or outside of the bag in the way of supplemental wrappings.

It is another object of the invention to provide an easy opening, peelable closure at the top edge of a microwavable bag without the need for employing an inner liner of film whose seal strength would normally be inferior.

It is a further object of the present invention to permit the use of a wide variety of high seal strength films as the inner layer while also providing for a closure at the top edge of such packages which may be easily opened and ventable to internal steam from the package.

Another significant object of this invention is to provide an upper seal of adhesive that masks the normal stronger seal that is attained between the film(s) forming the microwavable package.

These and other objects may become more apparent to those skilled in the art upon reviewing the summary of this invention and upon undertaking a study of the description of the preferred embodiment, in view of the drawings.

This invention generally provides a multi-laminar structured bag, having either a paper or polymer outer coating, and an inner film layer impervious to moisture and non-wicking coating over the inner layer and at the top edge of the microwavable package incorporating an adhesive seal sufficient to seal the opening into a closure which is ventable but which masks the heat sealability of the inner layer of film sufficiently to be easily opened by the consumer.

BRIEF DESCRIPTION OF THE DRAWINGS

In referring to the drawings, FIG. 1 provides an isometric view of the calendar rolls of laminant and the station for applying adhesive, the station for laminating, the station for printing the upper adhesive strip, the station for forming the laminated sheet into the tubular form, the station for cut-off and bottom fabrication, and a further view of the final bag.

DETAILED DESCRIPTION OF THE PREFERRED EMBODIMENT

Figure 1:
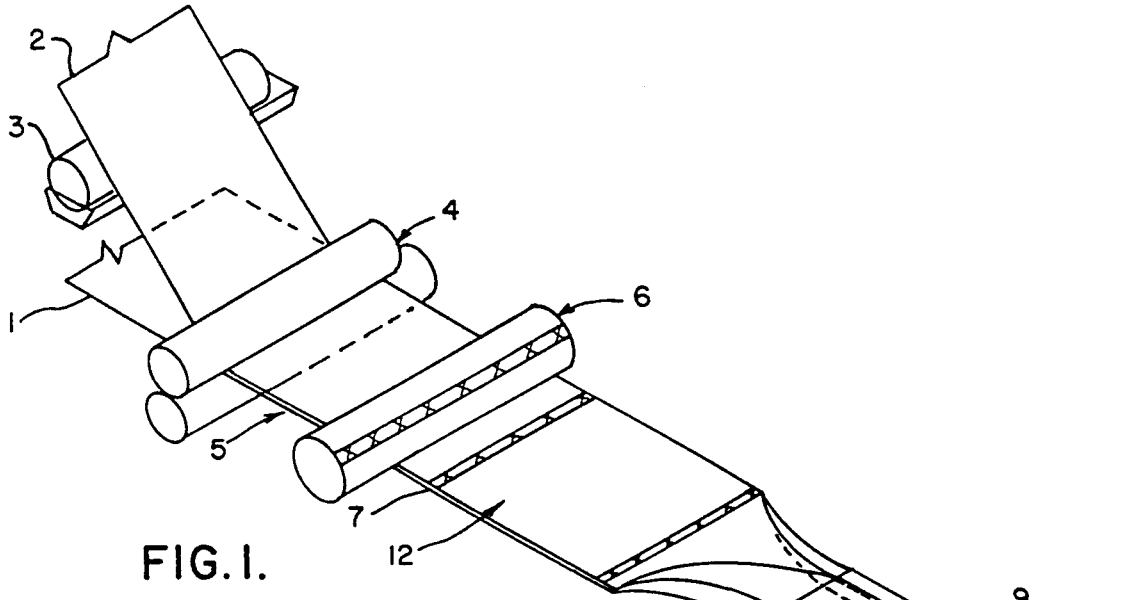

In general, the package or bag of this invention is of a size suitable to accommodate the food to be packaged and in a shape of standard self-opening style bag configuration. This normally is a package which has a series of walls, namely, side walls $S_1$ and $S_2$ a bottom wall B. There may be a back and front wall E and F together with gusseted formed side walls. All of the walls are sealed together into a permanent structure, leaving however an opening at the top of said package. This opening is sealed into closure, as through heat and pressure sealing, or the like, after the food or other substance is deposited therein, for eventual cooking. The bag is primarily made of multiple plys or laminants comprising at least an outer liner for the bag, and an inner liner of which will be subsequently described. Other layers may include an inner lining and to enhance the heat sealing characteristics of the bag, a fourth layer or coating may be added onto the interior of the inner ply. It is an essential feature of the present invention that a strip of heat sealable adhesive be coated at the top edge of the opening on its inner side, which seal strength shall form the characteristic peelable and easy opening feature of the present invention.

The inner ply or layer is composed of a film suitable to withstand the heat generated in the microwave oven when in contact with selected foods such as popcorn kernels. Then the inner layer should be non-wicking and impervious to moisture. Its seal strength with the applied adhesive strip is less than that obtained from the standard formed mylar lined bag. Such suitable films for the liner may be, for example, Mellinex polyester film, having a crystalline and polyester base and including an amorphous polyester substituent coextruded therewith. The Mellinex film composition is available from I.C.I. Americas, Inc. of Wilmington, Del. As previously stated, the inner layer should be non-wicking and heat-sealable, in those required areas proximate to the sides, or at the manufacturer's joint for the bag, at its bottom segment, and also along the top edge thereof, which in the present instance, will be coated with a strip of heat-sealable adhesive, as aforesaid, to mask the normal seal strength of the inner layer in order to accommodate the easy opening and closure after the package has been filled with its contents. This strip of heat-sealable adhesive will be explained subsequently.

The outer layer of laminar material forming the structured bag is preferably paper, glassine paper, or polymer film, suitable for use in a microwave oven such as a polyester film available from a wide range of film manufacturers. Usually, but not necessarily, where paper is used it may be oil-stain resistant treated such as with the standard type of treatment readily available.

A middle or intermediate ply may also be employed, and may be formed of a film, paper, glassine paper, Kraft paper, or the like suitable to be laminated to the inner ply in such a way as to form a middle barrier. Such film may be a polyester crystalline type, such as Mylar, or a coated paper, such as glassine type, or a polypropylene. The purpose of these films is to provide an additional moisture barrier as against the migration of moisture into the bag, but yet remain compatible with the heat requirements of the specific food being packaged and subsequently heated and cooked by the microwave energy.

As previously described in accordance with this invention, a registered printed strip of heat sealable adhesive appears on the top edge proximate the opening of the bag in order to form a closure. The heat sealable adhesive is compatible to the substrate of the inner layer and formulated to mask the heat sealability of the inner layer of film so as to replace that heat seal capability with the heat seal characteristics of the adhesive itself. Such adhesives may be for example a resin base adhesive. It is preferable to employ an adhesive made of a polyvinyl alcohol or PVA. One source of such adhesive is Ajax PVA, and sold under the trade name Ajax, by Ajax Adhesives of Chicago, Ill. The seal strength of the adhesive should be no greater than or less than the liners to which it is applied. Such a seal strength will furnish the strip of adhesive with such strength that it remains closed during storage, distribution and cooking, while at the same time, being sufficiently pervious to steam to allow its venting when created during cooking. Yet it is a weak enough seal that it allows the consumer to easily open the package after cooking. This easy opening characteristic may be described as peelability, and emulates the type of seal previously obtained from heat sealable films made by DuPont, such as polyethylene, and sold as DuPont 500 L. However, since this current seal of adhesive printed strip only occurs at the upper closure point of the microwable bag, the inner layer itself may be composed of far stronger seal strength film than the DuPont film, and accordingly, eliminates the need for additional reinforcement through the addition of supplemental package reinforcing structural materials.

In accordance with the manufacture of the microwavable bag of the present invention, a series of aligned equipment is provided and is adapted to include a station for adding a registered printed strip of adhesive along the laminated sheet of packaging material at intermediate positions designed to represent the intended top edge of the package. At FIG. 1, the outer layer 1 may be laminated onto the inner film 2, with an adhesive 3 being applied as shown, and the layers being calendered through the laminator station 4 in order to form the composite laminated sheet 5. At station 6 locates an adhesive strip printer for printing an adhesive segment 7, as previously explained, onto the laminated sheets proximate to where the top edges of the bags may be located. The combined sheets then proceed through machinery, as noted, to form the co-laminated sheet into a four-sided tube 8. The tube is progressively cut at station 9 and a bottom formed at 10 in order to result in the finished bag 11. Normally, the bags are gusseted at their sides by suitable equipment.

Figure 2:
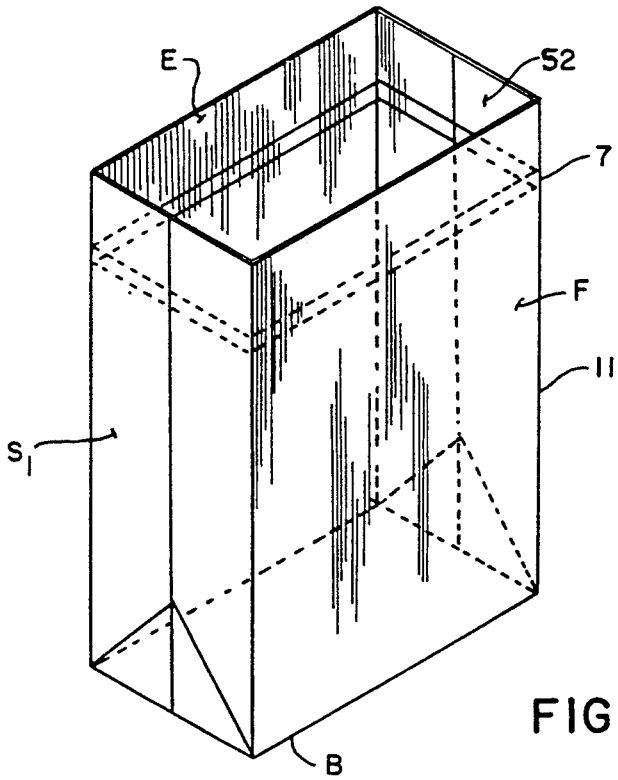
FIG. 2 is a broader isometric view of the finished bag.

At FIG. 2, the adhesive strip 7 for forming a seal at the top closure of the bag may be observed.

Obviously, the microwave bag of this invention may be formed of more than a pair of laminated sheets, as previously explained, and may in fact be fabricated from a series of plies forming an inner, intermediate, and outer laminated sheet, in the manner as previously explained in this application. Although it is likely that a single layer(s) of sheet could form the package. In any event, the printing of the adhesive strip by means of a gravure roll, as at 7, for the purpose of orienting the final top seal for the fabricated bag will be yet applied upon the upper surface 12 of the laminated sheet, before the bag is formed, and will, in effect, be the same as printing that adhesive composition onto what will be the intended interior side of the inner laminated film that eventually forms the interior of the configured bag.

Variations or modifications to the structure and assembly of this invention may occur to those skilled in the art upon reviewing the subject matter of this disclosure. Such variations or modifications, if within the spirit of this invention, are intended to be encompassed within the scope of any claims to patent protection issuing upon this invention. The depiction of the invention in the preferred embodiment, and its disclosure in the drawings, is primarily set forth for illustrative purposes only.

Having thus described the invention what is claimed and desired to be secured by Letters Patent is:

1. An easy opening, ventable bag that is sufficiently microwave transparent for use in heating food contained therein in a microwave oven, said bag comprising a multi-layer laminate film folded into a series of walls, including bottom and side walls each joined to form said bag by a manufacturer's joint and bottom wall seals provided in both the side walls and bottom wall thereof, said side walls having a sealable opening at the top of the bag, said multi-layer laminate comprising at least an innermost, heat sealable layer and an outer layer for the bag walls, said layers forming said multi-layer laminate being calendered together at a laminator station before the bag is formed, said outer layer of said laminate comprising either paper or a polymer film, said innermost layer comprising a heat sealable polyester composite film, said bag further comprising a strip of heat-sealable adhesive coating having its own seal strength less than that of said bag innermost layer heat seal strength, said strip being printed onto said innermost layer of said laminate proximate the top edge of the side walls of the bag thereof before said bag is formed, said adhesive being present in an amount sufficient to mask the heat sealability of said innermost layer of heat-sealable film at said top edge thereof, said heat-sealable strip of adhesive comprising a resin base adhesive formed of polyvinyl alcohol, said printed heat-sealable strip of adhesive being sealed to itself across the open top of the bag to seal closed said top opening of said bag with a food to be microwave heated contained therein, said printed heat-sealable strip of adhesive being sealed to itself across the bag to a degree and present in an amount sufficient to seal the opening into a closure, but which is capable of venting steam through said sealed adhesive strip when steam is created during cooking but which masks the heat sealability of said innermost layer of film and is sufficiently weak to allow the package to be easily peeled open at said top seal after cooking, said venting occurring without sacrificing and rupturing of the manufacturer's joint and bottom seal of the bag.

* * * * *